US005762274A

United States Patent [19]

Jacobson

[11] Patent Number: 5,762,274

[45] Date of Patent: Jun. 9, 1998

[54] PROTECTION ARRANGEMENT FOR A HOPPER SEAL ON A FLUID FLUSHED CONICAL CRUSHER

[75] Inventor: Charles R. Jacobson, Greendale, Wis.

[73] Assignee: Nordberg, Inc., Wis.

[21] Appl. No.: 690,862

[22] Filed: Aug. 1, 1996

[51] Int. Cl.[6] ..... B02C 2/04

[52] U.S. Cl. ..... 241/207; 241/216; 241/DIG. 30

[58] Field of Search ..... 241/DIG. 30, 207, 241/216, 215, 38

[56] References Cited

U.S. PATENT DOCUMENTS

| | | | |
|---|---|---|---|
| 3,371,875 | 3/1968 | Gasparac et al. | 241/207 X |
| 3,420,457 | 1/1969 | Peters er al. | 241/207 |
| 4,084,756 | 4/1978 | Coxhill | 241/213 |
| 4,147,309 | 4/1979 | Vroom | 241/215 |
| 4,179,076 | 12/1979 | Barrot et al. | 241/216 |
| 4,384,684 | 5/1983 | Karra | 241/26 |
| 4,477,030 | 10/1984 | Vifian et al. | 241/208 |
| 4,478,373 | 10/1984 | Gieschen . | |
| 4,659,026 | 4/1987 | Krause et al. | 241/275 |
| 4,750,679 | 6/1988 | Karra et al. | 241/41 |
| 5,031,843 | 7/1991 | Motz | 241/21 |
| 5,372,318 | 12/1994 | Jacobson | 241/207 |

FOREIGN PATENT DOCUMENTS

| | | | |
|---|---|---|---|
| 1592032 | 9/1990 | U.S.S.R. | 241/207 |
| 8200600 | 3/1982 | WIPO | 241/207 |
| 8303779 | 11/1983 | WIPO | 241/207 |

*Primary Examiner*—John M. Husar
*Attorney, Agent, or Firm*—Foley & Lardner

[57] ABSTRACT

A protection arrangement for a hopper seal in a conical crusher having a material feed hopper located within the upper portion of the crusher bowl, over the crusher bowl liner. The protection arrangement preventing material and liquid flowing from the hopper into the crusher bowl from flowing against and abrading components of the hopper seal. The protection arrangement including an upwardly extending lip on the bowl liner which is received within a discharge hole in the bottom of the hopper.

20 Claims, 2 Drawing Sheets

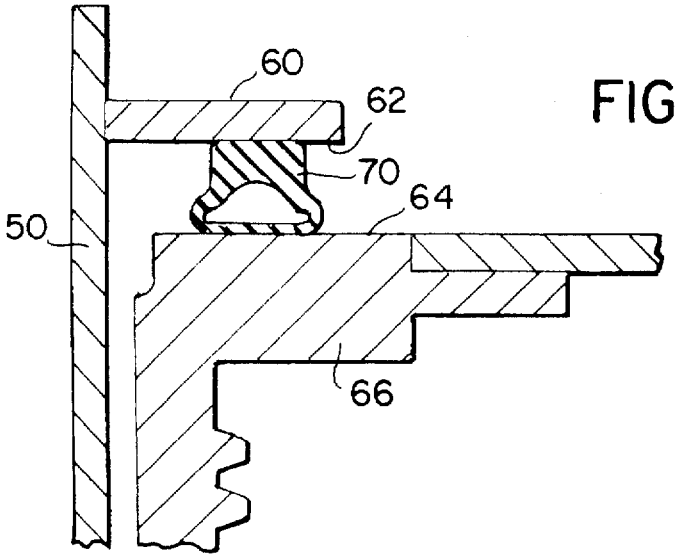
FIG. 2
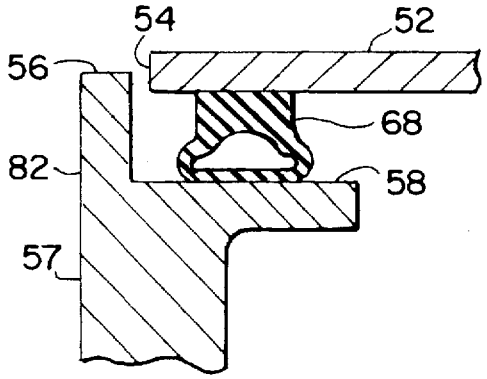
FIG. 3
FIG. 4
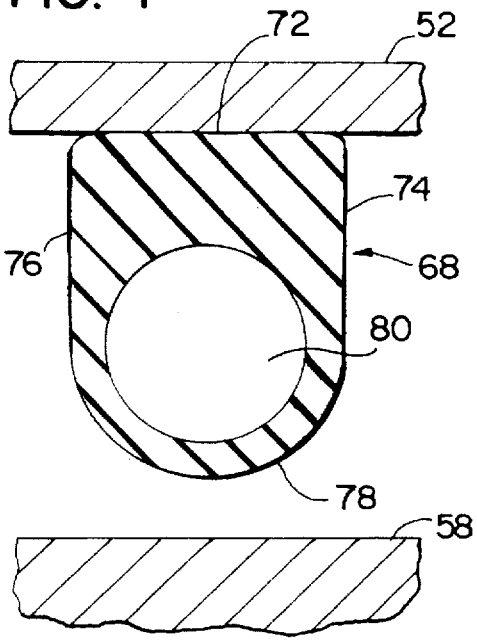
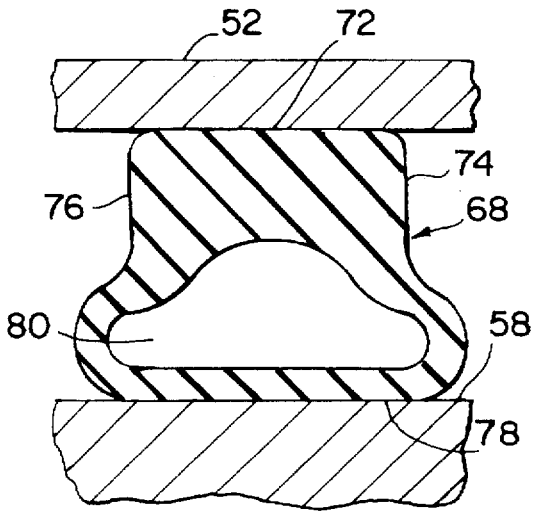
FIG. 5

PROTECTION ARRANGEMENT FOR A HOPPER SEAL ON A FLUID FLUSHED CONICAL CRUSHER

CROSS REFERENCE TO RELATED APPLICATIONS

The present application is related to U.S. application Ser. No. 08/690,866now abandoned entitled, "Hopper Seal For Fluid Flushed Conical Crusher," filed on an even date herewith, assigned to the Assignee of the present invention and invented by Jacobson.

FIELD OF THE INVENTION

This invention relates to a conical crusher, and more particularly to crushers provided with a material feed hopper positioned above the crusher to dispense material to be crushed into the crusher. To aid in the crushing operation, such crusher are frequently provided with a fluid or liquid feed which dispenses a fluid or liquid through the material feed hopper directly into the crushing cavity of the crusher.

BACKGROUND OF THE INVENTION

Conical crushers have been provided in the past with material feed hoppers located over the central cone or mantle and bowl liner, and within an upwardly extending portion of the crusher bowl. Material to be crushed is dispensed from the feed hopper into the crushing cavity formed between the mantle and the bowl liner. To improve the performance of such crushers, a liquid, generally water is directed into the crushing cavity through nozzles located above the material feed hopper. In such crushers, the crusher bowl is adjustably supported on the crusher frame to permit it to be raised or lowered with respect to the frame. Securing or clamping arrangements are provided to support the bowl liner within and on the crusher bowl. By adjusting the vertical position of the bowl liner, the position of the bowl liner with respect to the mantle is adjusted to adjust the width of the crushing cavity between the bowl liner and the mantle.

In such crushers it is most desirable to prevent the material being crushed and particularly the liquid added to it from entering the confined space defined by the crusher bowl liner, the crusher bowl, and the material hopper. The entry of the material being crushed and particularly the liquid, which is usually water, into the confined space can cause corrosion of the securing or clamping arrangement used to support the bowl liner within and on the crusher bowl, thereby making release of the securing arrangement for the purpose of replacing the bowl liner most difficult. Further, the entry of liquid and the material being crushed into the confined space may result in caking of the material in the confined space. This caked material may be most difficult to remove when it becomes necessary to remove and replace a worn bowl liner.

While material feed hoppers have been resiliently supported on the bowl liner and/or bowl of conical crushers in the past, the resilient supporting arrangement has not provided a sealing arrangement to prevent material being crushed and liquid introduced into the hopper from reaching the above-mentioned confined space. In such conical crushers the resilient support has been provided a porous resilient member through which a liquid and fine material may pass.

SUMMARY OF THE INVENTION

The present invention relates to a water flush conical crusher having a bowl, a bowl liner located within and supported on the bowl, a feed hopper and a liquid resilient member interposed between the bowl liner and the hopper. The water flush conical crusher includes a ridge disposed on the bowl liner. The ridge is configured to protect the member when the member is placed between the bowl liner and the hopper.

The present invention also relates to a bowl liner for a water flush crusher. The water flush crusher includes a seal disposed between the bowl liner and another portion of the rock crusher. The bowl liner includes an inside conical surface having a top side and a bottom side, an inside vertical surface having a bottom side integral to the top side of the inside conical surface, an outside conical surface having a top side and a bottom side, an outside vertical surface having a top side and a bottom side, a horizontal surface adjacent to the top side of the outside vertical surface, and a lip. The bottom side of the inside conical surface is adjacent the bottom side of the outside conical surface. The bottom side of the outside vertical surface is integral to the top side of the outside conical surface. The lip is formed above the horizontal surface and the top side of the inside vertical surface. The lip has a width approximately less than 60% of the distance between the inside vertical surface and the outside vertical surface. The lip protects the seal disposed between the bowl liner and the another portion of the rock crusher.

The present invention even further relates to a method of manufacturing or repairing a conical crusher. The conical crusher includes a liquid resilient seal disposed between a bowl liner and a hopper. The method includes steps of positioning a lip of the bowl liner adjacent a bottom side of the hopper to protect the liquid resilient seal, and securing the bowl liner to the rock crusher.

In a conical crusher having a material feed hopper located over the central cone or mantle and bowl liner, and within an upwardly extending portion of the crusher bowl, and having a sealing arrangement to prevent the entry of material being crushed into a confined space defined by the crusher bowl, bowl liner, and hopper, it is an aspect of this invention to provide an arrangement for protecting the sealing system between the bowl liner and the feed hopper. It is another aspect of the invention to provide in a conical crusher as described above, having a liquid feed which dispenses a liquid through the material feed hopper into the crushing cavity of the crusher, an arrangement for protecting the sealing system which prevents the entry of the liquid and the material being crushed into the confined space defined by the crusher bowl, bowl liner, and hopper from abrasion and wear by the material and liquid passing through the hopper into the crusher cavity. It is still another aspect of this invention to provide protection for the sealing system between the hopper and the bowl liner without adding additional separate parts to the crusher which would result in additional costs in manufacturing and assembling the crusher.

In accordance with another aspect of this invention, a conical crusher provided with a sealing arrangement such that material placed in the hopper and liquid directed into the hopper are prevented from reaching the confined space defined by the bowl liner, bowl and hopper, is provided with an arrangement for protecting the portion of the sealing arrangement between the hopper and the bowl liner. The material feed hopper is located within an upwardly extending portion of the crusher bowl, and over the crusher bowl liner. A pair of resilient non-porous members, one interposed between facing surfaces of the bowl and the hopper, and the other between facing surface of the bowl liner and the hopper, form seals between the hopper and the bowl and between the hopper and the bowl liner. The hopper is supported on the pair of resilient non-porous members, such that the weight of the hopper provides a compressive force on the resilient non-porous members to cause them to sealingly engage the hopper and the bowl and bowl liner facing surfaces. The upper edge of the bowl liner is provided with an upstanding lip which closely surrounds the edge of a hole in the bottom of the hopper through which material and liquid flows from the hopper into the crusher cavity. This lip protects the resilient non-porous member between the hopper and the bowl liner from being contacted by the material and liquid flowing from the hopper into the crusher cavity.

BRIEF DESCRIPTION OF THE DRAWINGS

FIG. 2 is an enlarged cross-sectional view of the encircled portion 2—2 of the elevational view shown in FIG. 1;

FIG. 3 is an enlarged cross-sectional view of the encircled portion 3—3 of the elevational view shown in FIG. 1;

FIG. 4 is a further enlarged cross-sectional view of the resilient member shown in FIG. 3, in an un-compressed state; and FIG. 5 is a further enlarged cross-sectional view of the resilient member shown in FIG. 3, in a compressed state

DETAILED DESCRIPTION OF THE PREFERRED EMBODIMENTS

Figure 1:
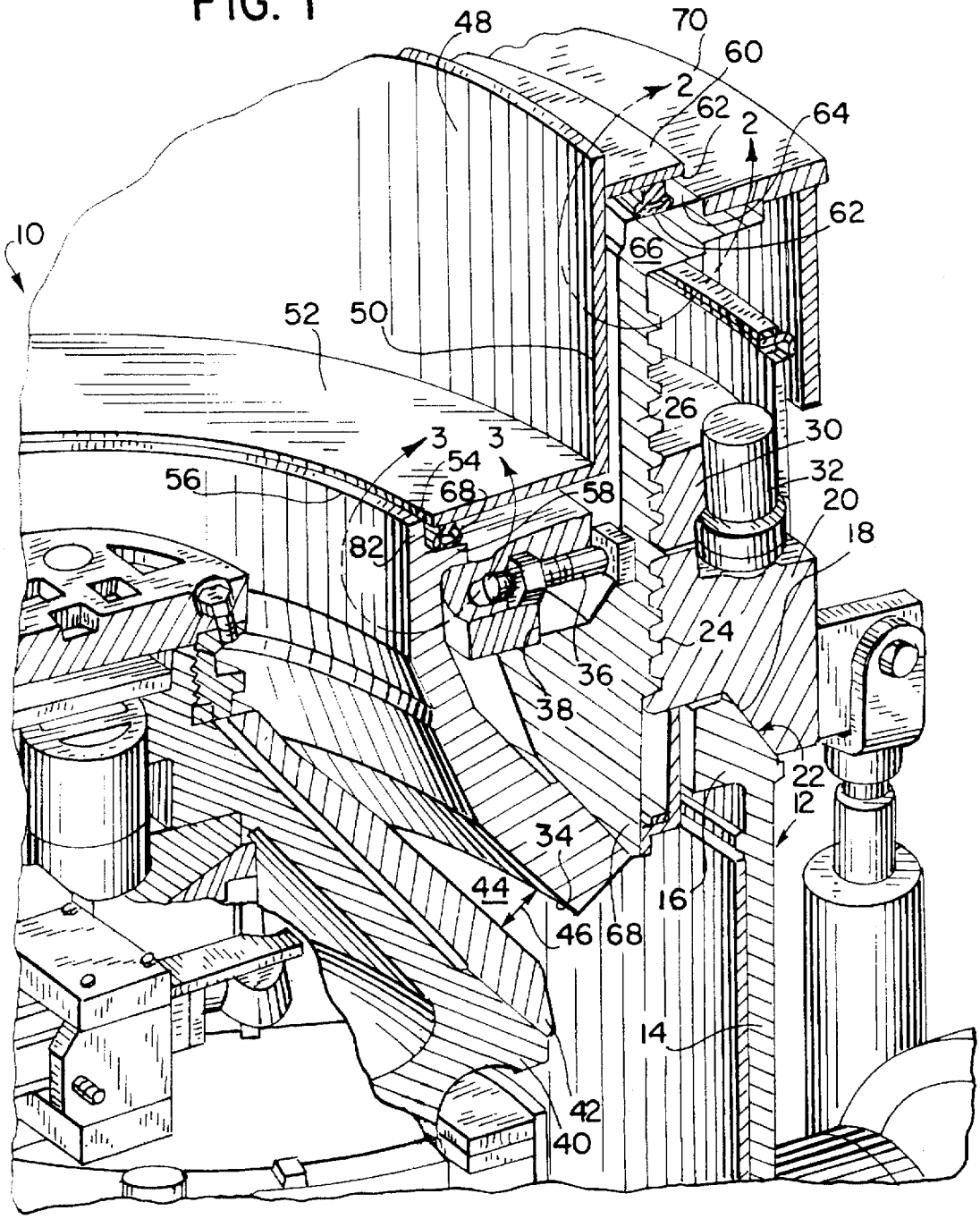
FIG. 1 is a fragmentary perspective elevational cut-away view of a conical crusher showing a sectional view of a sealing arrangement in accordance with this invention.

Referring to FIG. 1, a portion of a water flush crusher or conical grinder 10, provided with a sealing arrangement in accordance with this invention, is shown. The details of conical crushers are generally known to those involved in the art; conical crushers are disclosed in commonly assigned U.S. Pat. No. 4,967,967, issued to Karra et al on Jun. 9, 1987 and commonly assigned U.S. Pat. No. 4,478,373, issued to Gieschen on Oct. 23, 1984.

The crusher 10 includes a mainframe housing 12 having a vertical cylindrical wall 14, the upper edge of which is provided with a thickened portion 16 having a frustroconical surface 18 which forms a ring seat. An adjustment ring 20 is formed with a frustroconical surface 22 which rests on the frustroconical surface 18. The adjustment ring 20 is provided with a threaded cylindrical inner surface 24, which engages a threaded surface 26 provided on the cylindrical outer surface of a crusher bowl 28. The vertical position of the crusher bowl 28 with respect to the housing 12 may be adjusted by rotating the crusher bowl 28 and the adjustment ring 20 with respect to each other. When in a desired position, the crusher bowl 28 is prevented from turning with respect to the adjustment ring 20 by a clamping ring 30, and one or more pressure cylinders 32 which exert a locking force between the two rings.

Supported within and by the crusher bowl 28 is a bowl liner 34. The bowl liner 34 is clamped to the crusher bowl 28 by a clamping or securing arrangement including a threaded member 36 and a nut 38 which are rotated with respect to each other to exert a clamping force between the bowl liner 34 and the bowl 28. That clamping force, together with the engagement of the lower ends of the bowl liner 34 and the bowl 28, secures the bowl liner 34 to the bowl 28.

A conical head 40 is supported on a portion of the mainframe housing 12 within the bowl liner 34. The conical head is provided with a detachable liner or mantle 42 which is spaced from the bowl liner to define a crushing cavity 44. The crushing cavity 44 has a width 46 which is set prior to a crushing operation by adjusting the position of the crusher bowl 28 with respect to the mainframe housing 12 as previously described.

A material feed hopper 48 is positioned over the conical head 40 and the bowl liner 34, and generally within the bowl 28. The material feed hopper 48 is formed with a cylindrical vertically extending wall 50, and a horizontal cylindrical bottom 52. A cylindrical opening is provided in the bottom 52, with edge 54 of the opening surrounding an upper edge 56 of the bowl liner. A horizontally extending surface 58 is formed near the upper edge of the bowl liner 34 to support the bottom 52 of the feed hopper 48 adjacent the edge 54 of the cylindrical opening. The feed hopper 48 is also provided with a ring 60 near its upper end, which provides a horizontal surface 62 located above a horizontal surface 64 provided by an outwardly extending ring 66 formed at the upper edge of bowl 28.

In accordance with a preferred embodiment of this invention, the material feed hopper 48 is resiliently supported on the bowl liner 34 and the bowl 28. A non-porous resilient member 68 is interposed between the horizontally extending surface 58 formed near the upper edge of the bowl liner 34 and the bottom surface of the feed hopper 48 which surrounds the edge 54 of the cylindrical opening. A similar non-porous resilient member 70, is interposed between the horizontal surface 62 provided by the ring 60 and the horizontal surface 64 provided by the outwardly extending ring 66 formed at the upper edge of bowl 28. Not only do the resilient members 68 and 70 support feed hopper 48, but they also provide, in accordance with a preferred embodiment of this invention, a sealing arrangement to prevent the entry of material being crushed into the confined space defined by the crusher bowl 28, the bowl liner 34, and the hopper 48.

Referring now to FIGS. 2 through 5, the resilient members 68 and 70 will be further described. FIG. 4, represents the shape of the resilient members 68 and 70 before a compressive force is applied between their upper and lower surfaces. While FIGS. 4 and 5 could represent either of the resilient members 68 or 70, since in the preferred embodiment they have the same cross-sectional shape, numerals are applied to FIGS. 4 and 5 assuming that they represent resilient member 68 interposed between the bottom 52 of the hopper 48 and the horizontal surface 58 formed near the upper edge of bowl liner 34.

The resilient members 68 and 70 are formed with a cross-sectional shape having a flat top 72, parallel side walls 74 and 76 extending generally perpendicular from the top 72, and a semicircular base 78. The resilient members 68 and 70 may be manufactured as elongated extrusions, with lengths being cut and the ends joined to form rings. A circular hole 80 is formed in the extrusion adjacent the semicircular base 78 to increase the resiliency of the member, such that said semicircular base is flattened by the weight of the hopper 48 to deform the hole to an oval shape as shown in FIG. 5.

In assembling a crusher with a sealing arrangement in accordance with this invention, the flat top 72 of the resilient members 68 and 70 is secured to the hopper by a suitable adhesive, which also served to provide a seal between the resilient members and the hopper. The flattening of the semicircular base 78 as shown in FIGS. 2, 3, and 5, serves to provide an enlarged sealing area between the resilient members 68 and 70 and the bowl liner 34 and the bowl 28 respectively.

To protect the non-porous resilient member 68 interposed between the bottom 52 of the hopper 48 and the bowl liner 34, the horizontal surface 58 formed on bowl liner 34 is located below the top surface 56 of an upwardly extending lip 82 formed at the inner edge of the top of the bowl liner 34, such that the ridge or lip 82 of the bowl liner extending above the horizontal surface 58 serves to protect the resilient member from continuing flowing contact with the material and fluid passing through the hole in the bottom 52 of the hopper 48 to the crushing cavity 44. The inner circular surface of the lip 82 is formed as a continuation of the inner surface of the bowl liner 34. While a narrow circular space between the outer surface of the lip 82 of the bowl liner and the edge 54 of the hole in the bottom 52 of the hopper 48 may permit some fine material and liquid to reach the resilient member 68, the liquid and material will be stagnant, and thus will not cause abrasive wear of the resilient member. The top surface 56 of the upwardly extending lip is formed to be essentially level with or slightly below the top surface of the bottom 52 of the hopper, such that material and liquids readily flow over the lip and into the crusher cavity, and are not directed into the narrow circular space which may be formed between the outer surface of the lip 82 of the bowl liner and the edge 54 of the hole in the bottom 52 of the hopper 48.

Lip 82 of bowl liner 34 preferably has a width of approximately 50% (e.g., 57%) of the general width of liner 34. The general width of liner 34 is preferably measured at a vertical section 57 of liner 34. The relatively small width of lip 82 reduces the amount of material for liner 34 and yet provides significant protection for member 68. Lip 82 extends approximately the same distance above surface 58 as the general width of liner 34. Ring 52 and ring 60 can include a ridge or groove for receiving member 68 and member 70, respectively.

Thus, the protection arrangement of this invention prevents materials and liquids introduced into the hopper 48 from continuously flowing by and abrading and wearing the components of the sealing system between the bowl liner 34 and hopper 48.

While a single embodiment of the invention has been shown, it should be apparent to those skilled in the art that what has been described is considered at present to be the preferred embodiment of this invention. In accordance with the Patent Statute, changes may be made in the protection arrangement for a sealing system in a conical crusher between a hopper and a bowl liner without actually departing from the true spirit and scope of this invention. The appended claims are intended to cover all such changes and modification which fall in the true spirit and scope of this invention.

What is claimed is:

1. A conical crusher having a bowl, a bowl liner located within and supported on said bowl, a material feed hopper having a top and a bottom, said hopper located within said bowl and positioned above said bowl liner, a sealing system being provided between said bottom of said hopper and said bowl liner, said bottom of said hopper being provided with an opening through which material may flow from said hopper into said bowl liner, said bowl liner being provided with an upwardly extending lip which extends within the opening formed in said bottom of said hopper, whereby material flowing from said hopper into said bowl liner is prevented from contacting said sealing system so as to prevent abrasive wear of said sealing system.

2. In the conical crusher of claim 1, said upwardly extending lip having an inner surface which is a continuation of the inner surface of said bowl liner.

3. In the conical crusher of claim 1, said bottom of said hopper having an upper surface essentially level with the top of said lip.

4. A bowl liner for a water flush crusher, the water flush crusher including a seal disposed between the bowl liner and a material feed hopper of the crusher, the bowl liner comprising:

an inside conical surface having a top side and a bottom side;

an inside vertical surface having a bottom side integral to the top side of the inside conical surface;

an outside conical surface having a top side and a bottom side, the bottom side of the inside conical surface being adjacent the bottom side of the outside conical surface;

an outside vertical surface having a top side and a bottom side, the bottom side of the outside vertical surface being integral to the top side of the outside conical surface;

a horizontal surface adjacent to the top side of the outside vertical surface, the horizontal surface adapted to support the seal; and a lip formed above the horizontal surface and the top side of the inside vertical surface, the lip having a width approximately less than 60% of the distance between the inside vertical surface and the outside vertical surface, the lip adapted to protect the seal disposed between the bowl liner and the material feed hopper of the rock crusher.

5. The bowl liner of claim 4 wherein the lip has a width of approximately 57% of the distance between the inside vertical surface and the outside vertical surface.

6. The bowl liner of claim 5 wherein the horizontal surface has a width approximately equal to the distance between the inside vertical surface and the outside vertical surface.

7. The bowl liner of claim 5 wherein the lip has a height approximately equal to the distance between the inside vertical surface and the outside vertical surface.

8. The bowl liner of claim 4 wherein the inside conical surface and outside conical surface are integrally connected by a bottom angled surface.

9. The bowl liner of claim 8 wherein the inside conical surface has a step.

10. The bowl liner of claim 4 wherein a ridge is disposed in the horizontal surface for receiving the seal.

11. The bowl liner of claim 4 wherein the horizontal surface includes a groove for receiving the seal.

12. The bowl liner of claim 4, wherein the seal is rubber.

13. The bowl liner of claim 6, wherein the combination of the width of the lip and a width of the horizontal surface is greater than the distance between the inside vertical surface and the outside vertical surface.

14. The bowl liner of claim 13, wherein the combination of the width of the lip and the width of the horizontal surface is more than twice the distance between the outside vertical surface and the inside vertical surface.

15. A conical crusher having a bowl, a bowl liner located within and supported on the bowl, a feed hopper, and a liquid resilient member interposed between the bowl liner and the hopper, the conical crusher comprising:

a ridge disposed on the bowl liner, the ridge configured to protect the liquid resilient member when the liquid resilient member is placed between the bowl liner and the hopper.

16. The conical crusher of claim 15, wherein the liquid resilient member is hollow rubber.

17. The conical crusher of claim 15, wherein the ridge is slightly spaced apart from the feed hopper.

18. The conical crusher of claim 17, wherein the ridge extends at a 90° angle from a horizontal surface on the bowl liner.

19. A conical crusher comprising:

a bowl;

a bowl liner located within and supported on the bowl;

a feed hopper;

a liquid resilient member interposed between the bowl liner and the feed hopper; and wherein a ridge is disposed on the bowl liner, the ridge configured to protect the liquid resilient member when the member is placed between the bowl liner and feed hopper, whereby material flowing from said hopper into said bowl liner is prevented from contacting said liquid resilient member so as to prevent abrasive wear of said liquid resilient member.

20. The conical of claim 19 wherein the liquid resilient member includes rubber.

* * * * *